United States Patent [19]

Herbert

[11] 4,172,397

[45] Oct. 30, 1979

[54] MACHINE FOR DE-CAPPING CONTAINERS

[75] Inventor: James F. Herbert, Walsall, England

[73] Assignee: Metal Closures Limited, West Bromwich, United Kingdom

[21] Appl. No.: 920,000

[22] Filed: Jun. 28, 1978

Related U.S. Application Data

[63] Continuation of Ser. No. 748,746, Dec. 9, 1976, abandoned.

[30] Foreign Application Priority Data

Dec. 5, 1975 [GB] United Kingdom ..... 50085/75

[51] Int. Cl.[2] ..... B67B 7/08

[52] U.S. Cl. ..... 81/3.2; 53/381 A

[58] Field of Search ..... 53/381 R, 381 A, 331.5, 53/332; 81/3.2, 3.3 R, 3.33

[56] References Cited

U.S. PATENT DOCUMENTS 1,249,025 12/1917 Carvalho ..... 81/3.2

1,598,392 8/1926 Risser ..... 81/3.2 X 2,656,084 10/1953 Filander ..... 81/3.2 X

*Primary Examiner*—James G. Smith

*Attorney, Agent, or Firm*—Bryan & Bollo

[57] ABSTRACT

A machine for de-capping containers having screw caps is responsive to the presence or absence of a cap on a container and includes an annular body mounted for rotation about a vertical axis and for upward and downward movement towards and away from a container. The body carries on its periphery vertical arms which are pivotable about tangentially extending axes, the lower ends of the arms carrying tools operable to grip the cap. Coaxially within the body is a plunger-like probe which is spring urged downward relative to the body and which operates a valve controlling a supply of pressure fluid to motors for operating the arms to grip a cap. If the probe contacts a cap on a container the valve is opened by the relative movement of the probe and body to operate the motors to cause the cap to be gripped. If no cap is present on the container the valve remains closed and the arms do not operate.

6 Claims, 6 Drawing Figures

MACHINE FOR DE-CAPPING CONTAINERS

This is a continuation, division, of application Ser. No. 748,746 filed Dec. 9, 1976 now abandoned.

This invention relates to a machine for de-capping containers which have screw caps and which are to be refilled or otherwise re-used. Some of the containers passed through the machine may already be capless, and in order to avoid damage to such containers and/or the machine it is desirable that the de-capping mechanism should not move to grip a cap when none is present.

According to this invention there is provided a machine for de-capping containers having screw caps, which machine comprises an annular rotary body mounted for rotation about its own axis and for axial movement towards and away from the top of a container, arms mounted on the body and respectively carrying tools for engaging opposite sides of a cap to be removed from a container, means for operating the arms to grip and release said cap, and a probe carried by the body for movement relative to the body and arranged so as during movement of the body towards the top of a container to contact a cap to be removed before the cap is engaged by said tools, the arrangement being such that said means for operating the arms is actuated only if the probe detects the presence of a cap on the container, movement of the probe relative to the body caused by abutment of the probe against the top of a cap initiating actuation of said means for operating the arms.

According to a preferred feature of the invention, said means for operating the arms comprises piston and cylinder motors on the body, a pressure fluid supply conduit to the motor cylinders having therein a valve which is initially closed but which is adapted to be opened by said movement of the probe relative to the body when the probe abuts the top of a cap.

According to another preferred feature of the invention, each of said arms has associated with it an individual adjustable stop for limiting the extent of inward radial movement towards the cap of the tool carried by that arm.

Figure 1A:
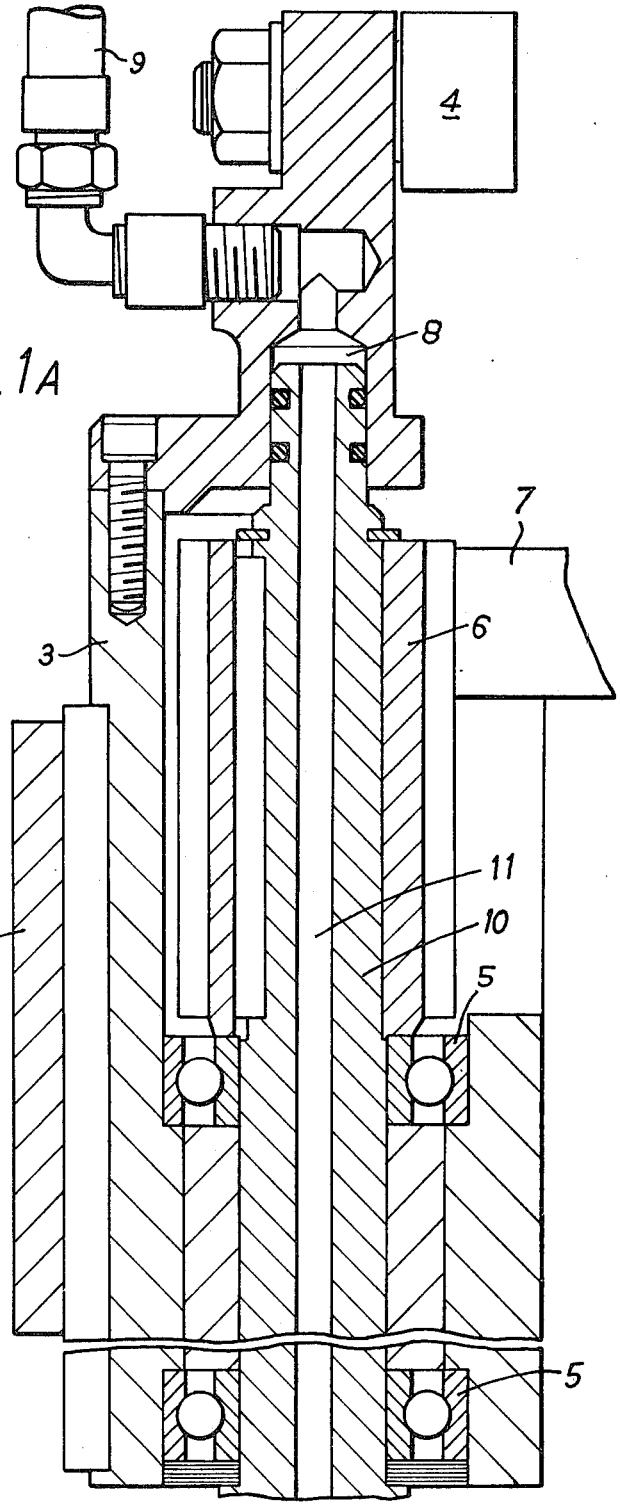
Figure 1B:
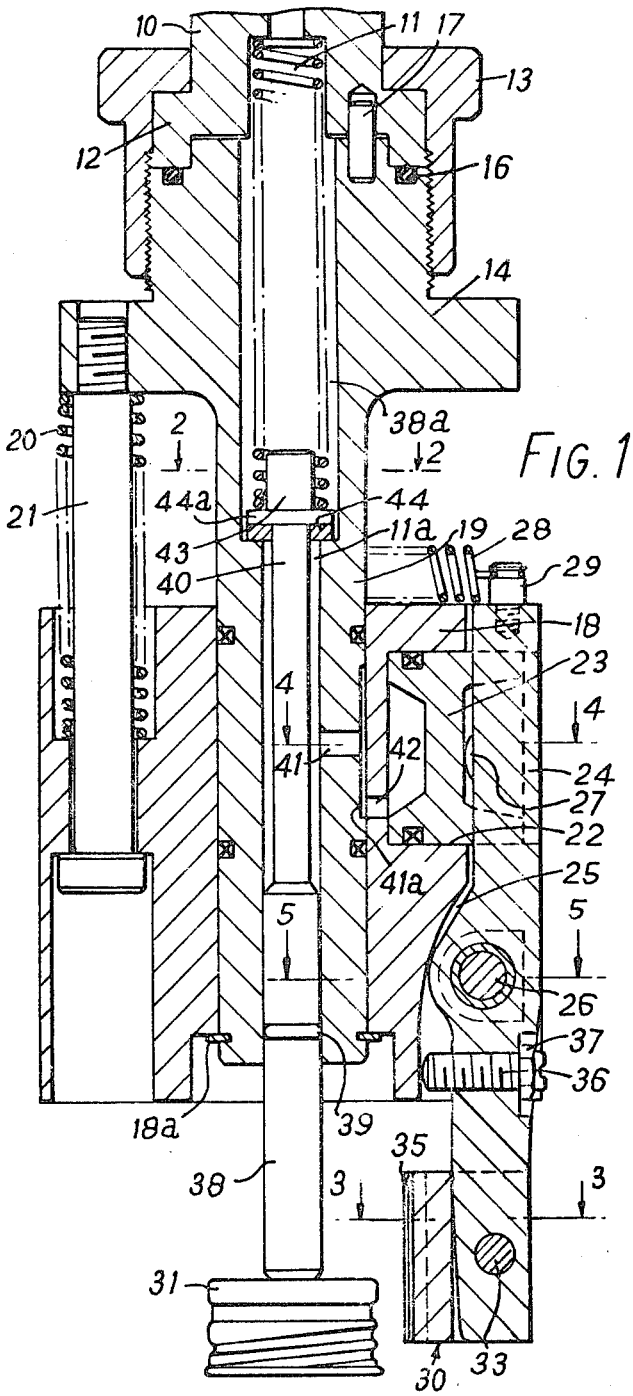

One embodiment of the invention will now be described by way of example with reference to the accompanying drawings in which:

FIGS. 1A and 1B together show in axial section part of a de-capping machine according to the invention.

Figure 2:
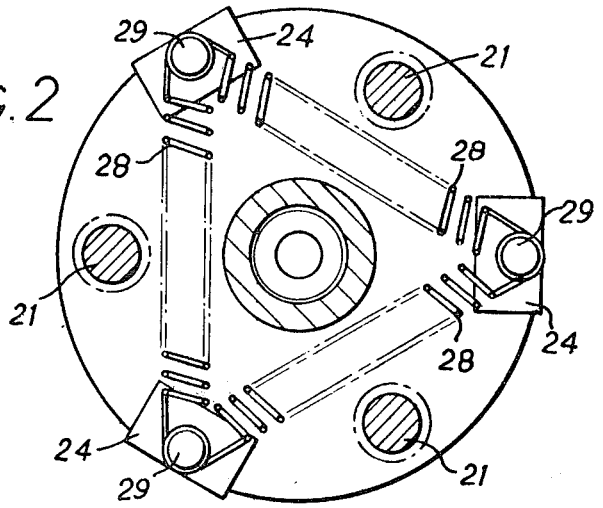
Figure 3:
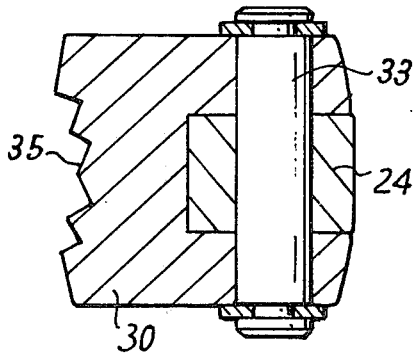
Figure 4:
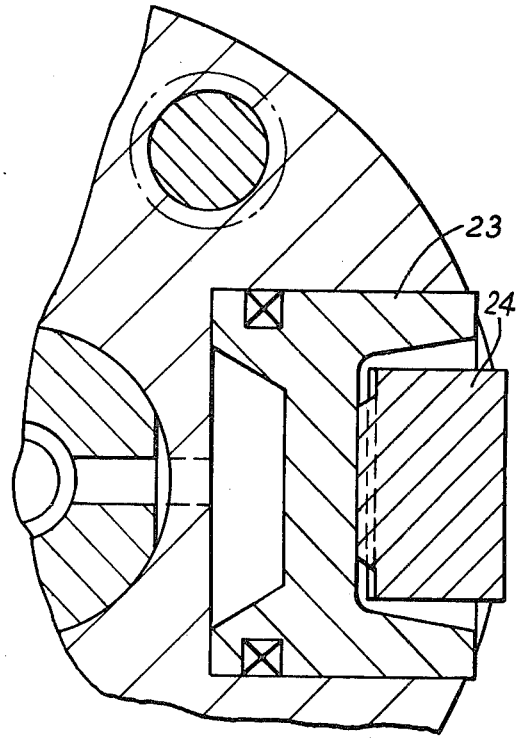
Figure 5:
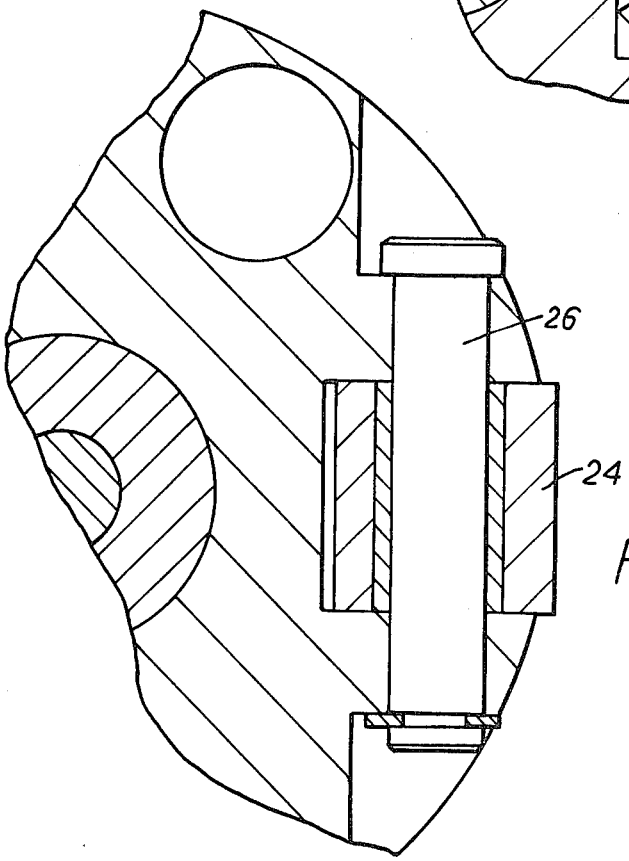

FIGS. 2 and 3 are local sectional views on the lines 2—2 and 3—3 respectively of FIG. 1B, and FIGS. 4 and 5 are respectively fragmentary sectional views on the lines 4—4 and 5—5 of FIG. 1B.

Referring to the drawings, reference numeral 3 indicates one of a number of head carriers mounted, in circumferentially spaced relation, in respective vertical slides 3*a* on a turret which rotates about a central vertical axis. Each head carrier 3 is suspended from a cam follower 4 which engages in a fixed cam track (not shown) extending about the turret axis and which is moved up and down by its engagement in the cam track as the head carrier moves round the turret axis on a rotary frame, causing the head carrier to move correspondingly in its slide on the turret. Each carrier 3 carries in bearings 5 a vertical rotary spindle 10 having an elongate pinion 6 secured to it which meshes with a fixed gearwheel 7 centred on the central axis of rotation so that the spindle spine as it is carried round the central axis by the turret and head carrier. The spindle has a central passage 11, and the top end of the spindle is received in a socket 8 in the head carrier. The socket, and hence the central passage 11 of the spindle 10, is connected through a flexible pipe 9 alternately to a source of air under pressure and to exhaust by a valve in timed relationship to the position of the spindle in its movement about the turret axis.

A flange 12 at the lower end of the spindle 10 is engaged by a nut 13 which is in screwed arrangement with one part 14 of a two-part body. The body part 14 is annular to provide a continuation of the central air passage 11 of spindle 10, leakage of the air being prevented by an O-ring clamped between the flange 12 and the upper end of body part 14. A drive pin 17 serves to transmit the rotary drive from the spindle 10 to the body.

The second body part 18 is axially slidably mounted on a reduced diameter portion 19 of body part 14 and is urged downwardly with respect to body part 14 by three springs 20 disposed about respective drive bolts 21 which extend slidably upward through holes in the body part 18 and are secured in threaded sockets in body part 14. The heads of bolts 21 and a circlip 18*a* disposed in a groove at the lower end of the body part 14 limit the downward movement of part 18 relative to part 14.

The body part 18 has three radially outwardly facing cylinders 22 equi-angularly spaced about its central axis and a piston 23 engaged in each cylinder has axial slots in its skirt to accommodate part of a lever arm 24 which is disposed in an axial slot 25 in the external surface of the body part 18. Each arm is mounted on a pivot pin 26 carried by the body part 18 and extending across the slot 25.

A part-cylindrical projection 27 on the arm provides the contact surface for engaging the piston, and the contact surfaces are held against the pistons by springs 28 (FIGS. 1B and 2) which extend between posts 29 on adjacent arms 24. At the inward extremities of their radial movement, the pistons abut the inner ends of the cylinder.

The lower end of each arm 24 extends below the lower extremity of the body part 18 and carries a tool 30. The three tools are adapted for jointly gripping the cap 31 to be removed from a bottle or other container. The tool is mounted on the lower end of the arm 24 by a horizontal bolt 33 and can swivel a small amount about the bolt to enable it to adapt to caps which are askew on their containers. The front face of the tool has a part-cylindrical groove 35 provided with vertical serrations for frictional engagement with the periphery of the cap. The swivelling of the tool allows the front face thereof to face horizontally or with a small downward inclination.

Radial inward movement of each tool 30 is individually adjustable by means of a stop-screw 36 which is in screwed engagement with the arm. The inner end of the screw comes into abutment with the radial wall of the slot 25 and the screw can be secured in any selected position by means of a lock-nut 37.

A probe 38 the lower end of which projects below the body part 18 is slidably mounted in the central bore of part 18 and is sealed with respect to the bore by an O-ring 39. The probe has a stem 40 of reduced diameter which forms with the wall of the bore an annular extension 11*a* of the central air passage 11, which communicates with the three cylinder bores 22 through respective radial passages 41 and axial grooves 41*a* in the stem 19 and radial passages 42 in the body part 18. Passage 42 opens to the cylinder opposite a depression in the crown of piston 23. At its upper end the stem of the probe has a flange 44*a* to which is bonded a rubber sealing ring 44. The ring forms a seal with an annular shoulder 18*b* in the bore of body part 18 to close off communication between the air passage 11 and its extension 11*a*. A spring 38*a* seated against a shoulder in drive spindle 10 acts against the flange 44*a* so as normally to hold sealing ring 44 on its seat.

In operation of the machine, containers with screw caps which are to be removed are fed underneath successive de-capping units as the units in their movement about the turret axis pass a loading station. During further movement of the unit round the turret axis, passage 11 is connected to a supply of air under pressure and the spinning drive spindle is lowered bodily towards the container by the operation of the fixed cam track and the cam follower on the head carrier. During the first part of this downward movement of the drive spindle, the probe 38 comes into abutment with the cap to be removed which thus prevents further downward movement of the probe, and as downward movement of the drive spindle continues the sealing shoulder 18*a* moves downward away from the sealing ring 44, compressing spring 46 and allowing air under pressure to flow from passage 11 along the extension 11*a* and through the radial passages 41, axial grooves 41*a* and radial passages 42 into the cylinders 22 to move the pistons radially outward and thus bring the shoe 34 into clamping engagement with the skirt of the screw cap. The spinning of the drive spindle unscrews the cap and the resulting upward force applied to the tools and arms 24 causes the body part 18 to move upward relative to the body part 14, compressing springs 21. The upward movement of the cap, still gripped by the tools, also pushes the probe upward, and continues until the cap is fully unscrewed and rests on the container. As the rotation of the turret proceeds the fixed cam track and cam follower 4 lift the head carrier so that firstly the body part 14 is lifted and spring 21 return body part 18 to its initial position relative to body part 14, and subsequently the gripped cap is lifted clear of the container as the upward movement of the head carrier continues. At an unloading station in the rotation of the head carrier about the turret axis, the container is removed from underneath the head carrier, for example by operation of a star wheel, and at the loading station another bottle to be de-capped comes into place beneath the head carrier. At a selected station between the unloading and loading stations, the central air passage 11 in the drive spindle is opened to exhaust through pipe 9, so that the arms 24 are returned to their starting positions by springs 28, releasing the cap from the grip of the shoes, which in turn allows the probe to be returned to its lowermost position by spring 38*a* so as to replace sealing ring 44 on its seat.

If there is no cap on the container, the probe meets no resistance during its downward movement and consequently does not lift the sealing ring 44 to admit admist air to the motor cylinders. The tools 30 are therefore not moved inward by the arms 24, and the risk of damage to the container and the machine is avoided.

I claim:

1. A machine for de-capping a container having a screw cap, which machine comprises an annular rotary body mounted for rotation about its own axis and for axial movement toward and away from the top of a container, jaws for engaging opposite sides of a cap to be removed from such container, individual piston and cylinder motors mounted on the rotary body and disposed about said axis which motors are connected one to each of said jaws for actuating the jaws to grip said cap, a pressure fluid supply conduit connected to supply pressure fluid to the cylinder of said motors, a valve in said conduit operable to open and close off the supply of pressure fluid to said motors and a probe carried by the body for movement relative to the body and arranged to project towards the top of such container to contact a cap to be removed, which probe is connected to the valve to open the valve only if the probe detects the presence of a cap on the container by reason of the probe contacting such cap during said axial movement of the body toward the top of the container.

2. A machine as claimed in claim 1, wherein the rotary body carrying the motors, the jaws and the probe is detachable as a unit from the machine.

3. A machine as claimed in claim 1 further comprising a plurality of lever arms pivotally mounted on the body for rocking movement about respective axes extending tangentially with respect to said axis of rotation of the body, said arms carrying the respective jaws and being respectively connected to said motor for actuating gripping movement of the jaws.

4. A machine as claimed in claim 3, further comprising an individual adjustable stop for each of said lever arms for limiting the extent of inward radial movement towards the cap of the jaw carried by that arm.

5. A machine as claimed in claim 3 wherein the body comprises two parts one of which carries the arms and is arranged to be capable of axial movement relative to the other part, said one part being spring-loaded towards the cap into a position of axial abutment with the other part.

6. A machine as claimed in claim 3, wherein each of said arms carries a pivot bolt extending tangentially with respect to the axis of rotation of the body on which pivot bolt the jaw is mounted.

* * * * *